United States Patent [19]

Stern

[11] Patent Number: 4,603,793

[45] Date of Patent: Aug. 5, 1986

[54] COUPLING DEVICE FOR CONNECTING A MATERIAL OUTLET TO A PACKING

[76] Inventor: Leif E. Stern, Fattershus, Lund, Sweden, 225 90

[21] Appl. No.: 738,907

[22] PCT Filed: Jan. 9, 1981

[86] PCT No.: PCT/SE81/00002

§ 371 Date: Dec. 10, 1981

§ 102(e) Date: Dec. 10, 1981

[87] PCT Pub. No.: WO81/01992

PCT Pub. Date: Jul. 23, 1981

Related U.S. Application Data

[63] Continuation of Ser. No. 333,860, Dec. 10, 1981, abandoned.

[30] Foreign Application Priority Data

Jan. 10, 1980 [SE] Sweden ..... 8000199

[51] Int. Cl.[4] ..... B65D 35/56

[52] U.S. Cl. ..... 222/105; 222/215; 383/906

[58] Field of Search ..... 222/80, 81, 88, 92, 222/89, 90, 183, 105, 107, 82, 542; 383/906

[56] References Cited

U.S. PATENT DOCUMENTS

| | | | |
|---|---|---|---|
| 3,081,911 | 3/1963 | Scholle | 222/105 |
| 3,138,293 | 6/1964 | Roak et al. | 222/105 |
| 3,243,084 | 3/1966 | Stegner | 222/105 |
| 3,767,233 | 10/1973 | Hodge | 285/239 |
| 4,008,831 | 2/1977 | Vidilles | 222/107 |
| 4,076,147 | 2/1978 | Schmit | 222/89 |
| 4,090,514 | 5/1978 | Hinck et al. | 222/105 |
| 4,214,675 | 7/1980 | Schmit | 222/105 |
| 4,375,864 | 3/1983 | Savage | 222/81 |

FOREIGN PATENT DOCUMENTS

| | | |
|---|---|---|
| 402978 | 5/1970 | Australia . |
| 403840 | 6/1970 | Australia . |
| 1104359 | 2/1968 | United Kingdom . |

*Primary Examiner*—Joseph J. Rolla
*Assistant Examiner*—Kenneth Noland
*Attorney, Agent, or Firm*—Schwartz, Jeffery, Schwaab, Mack, Blumenthal & Evans

[57] ABSTRACT

A coupling device for connecting a material discharge to a packing, preferably with walls of plastic foil for viscous material, comprises two interconnectable coupling members, one of which is mounted on the packing and the other on the material discharge. The coupling device permits application of a material discharge to the packing in a quick and efficient manner. A packing coupling is mounted on an unbroken wall portion of the packing and is provided with a separating portion disposed inside the packing. The separating portion comprises a grip portion for the material discharge coupling, side openings for flow-through of material and a support portion directed towards an opposed wall portion of the packing. The material discharge coupling is provided with a hole-punching portion for punching the unbroken wall portion and a grip portion which is designed to securably fit into the grip portion of the packing coupling after punching.

1 Claim, 4 Drawing Figures

COUPLING DEVICE FOR CONNECTING A MATERIAL OUTLET TO A PACKING

This application is a continuation of application Ser. No. 333,860, filed Dec. 10, 1981, now abandoned.

The present invention relates to a coupling device for connecting a material outlet to a packing, preferably designed for viscous material and having walls of plastic foil, whereby the coupling device comprises two interconnectable coupling means one of which is mounted on the packing and the other on the material outlet.

It is previously known to provide packings of various types with an opening and an outer connection piece at which a hose is connectable such that material may be fed out of the packing via the opening and the hose. Such an arrangement is suitable if the hose is applicable at the connection piece before the packing is filled with material or if a filled packing is easy to handle or form such that the hose may be applied afterwards without material flowing out, e.g. by temporarily turning the packing upside down so that the connection piece is directed upwards, which means that material can not flow out while the connection piece is opened and the hose is connected.

However, there are packings, e.g. of plastic foil, which are difficult to handle in such a way that a hose or another material outlet is quickly and efficiently applicable without risk for overflow.

The object of the present invention is to eliminate said problem and provide a device by simple means which permits application of a material outlet at the packing in a simple and efficient way without remedies and competence. According to the invention this is achieved at while the coupling means of the packing is mounted on an unbroken wall portion of the packing and provided with a separating portion arranged inside the packing and having a grip portion for the coupling means of the material outlet, side openings for through-flow of material and a support portion directed towards an opposed wall portion of the packing, whereby the coupling means of the material outlet has a hole-punching portion for punching the unbroken wall portion and a grip portion for securable fitting in the grip portion of the separating portion after punching.

BRIEF DESCRIPTION OF THE DRAWINGS

The invention will be further described hereinafter with reference to the accompanying drawings in which FIG. 1 with a side view illustrates a half-filled packing to which a hose is connected via a coupling device according to the invention.

DETAILED DESCRIPTION OF THE PREFERRED EMBODIMENT

Figure 1:
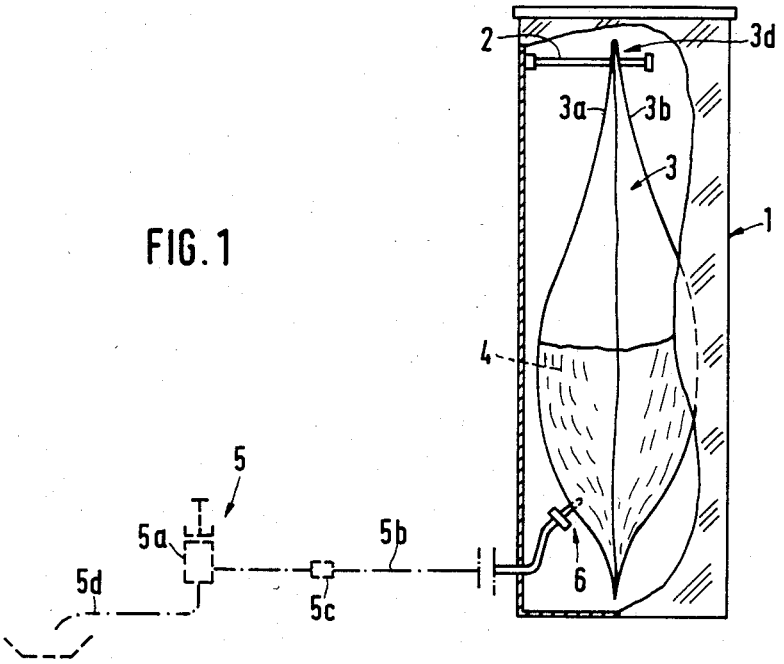

In FIG. 1 a container 1 is shown having a suspension device 2 on which a packing 3 is suspended. The packing 3 has two opposed walls 3*a* and 3*b* of foil material and contains a viscous mass 4, e.g. tomato ketchup, mustard or sauce. For feeding the viscous mass 4, the packing 3 is interconnectable to a feeding device 5 e.g. including a pump 5*a*, a conduit 5*b* for connection to the packing 3, a check valve 5*c* for preventing return flow of the mass 4 to the packing 3 and a conduit 5*d* extending from the pump 5*a* for portioning the viscous mass 4 out of the system. The pump 5*a* of the feeding device 5 is designed to suck out the viscous mass 4 from the packing 3 until it reaches the pump and to press out the mass 4 in the pump 5*a* via the portioning conduit 5*d*. Since such a principal of feeding is well known as well as devices for carrying out said principal, it has been only briefly described and the device shown schematically. In order to be able to connect said feeding device 5 or a material outlet of another type to the packing 3, a coupling device 6 is used having a coupling means 6*a* mounted on the packing 3 and a coupling means 6*b* mounted on the material outlet 5.

Especially regarding storage of food in the packing 3, it is essential that the packing can be transported and delivered completely sealed and breakage of the packing ought not be done before the content shall be drained off. In order to enable breakage of the packing when it is ready for portioning the material and permit said breakage to be carried out by anybody without the risk for overflow, and without tools or skill, the coupling means 6*a* of the packing 3 is mounted on an unbroken wall portion 3*a* of the packing 3 and the coupling means 6*a* has a separating portion 6*c* disposed inside the packing, said separating portion comprising a grip portion 6*p* for the coupling means 6*b* of the material outlet 5, side openings 6*h* for through-flow of material from the interior of the packing 3 to the material outlet 5 and a support portion 6*g* directed towards an opposed wall portion 3*b* of the packing 3. The coupling means 6*b* of the material outlet 5 is provided with a hole-punching portion 6*d* (formed by the end edge of the coupling means 6*b*) designed for punching the unbroken wall portion 3*a*. The coupling means 6*b* has also a grip portion 6*r*, preferably with peripheral teeth and with conically tapering shape, which is designed to fit into the grip portion 6*p*, after breaking the wall portion, until the coupling means 6*b* is connected to the coupling means so that they can be separated only by applying greater separating forces onto the coupling.

Figure 4:
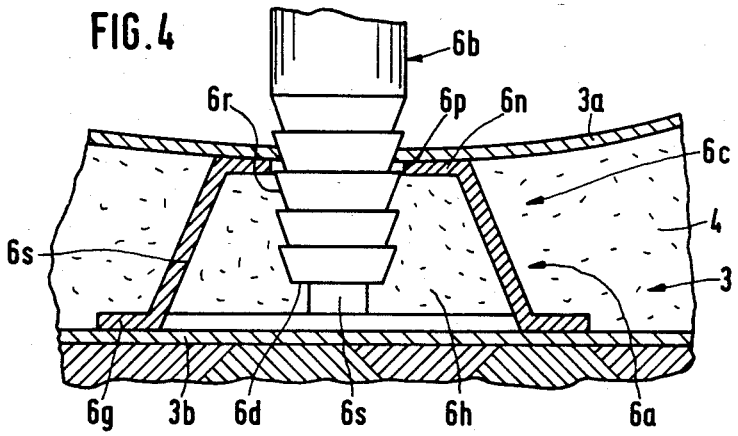

By placing the wall portion 3*b* to engage an underlayer and design the coupling means 6*b* with sufficient height, the coupling means 6*b* may be pressed towards the wall portion 3*b* until the supporting surface 6*g* engages the wall portion 3*b* (see FIG. 4), whereby the coupling means 6*b* forms a holder-on during the punching moment. Furthermore, the coupling means 6*b* has a separating function in such a way that it separates the wall portions 3*a*, 3*b*, 3*d* of the packing 3 when draining off the packing, so that said wall portions do not prevent draining off of the last portions of the material. Instead, the separating portion 6*c* forms pockets from which the material may flow and the wall portions will take part in the formation thereof by folding in a suitable manner.

Thus, the coupling means 6*a*, 6*b* have a greater number of functions which are all essential for the desired result while said means permit efficient breakage of the packing 3, quick-connection and separation of the packing 3.

While the coupling means 6*a* of the packing 3 is entirely mounted within the wall portion 3*c*, the packing 3 will down below have no protruding parts which during transport may stick and cause damages.

In order to ensure that the coupling means 6b does not reach too far into the coupling means 6a so that it can not receive the last remains of the material and disturb the supporting function of the coupling means 6a, the grip portions 6p, 6r of the coupling means 6a, 6b may be designed so that the coupling means 6b of the material outlet 5 reaches a limit position for connection relative to the coupling means 6a of the packing 3 before it has reached the support portion 6g of the coupling means 6a of the packing 3.

While the grip portion 6p of the coupling means 6a comprises a thin ring 6n which is mounted on the wall portion 3a and which preferably is made of elastic material, the grip portion 6p may take a suitable form at application of the coupling means 6b.

Figure 2:
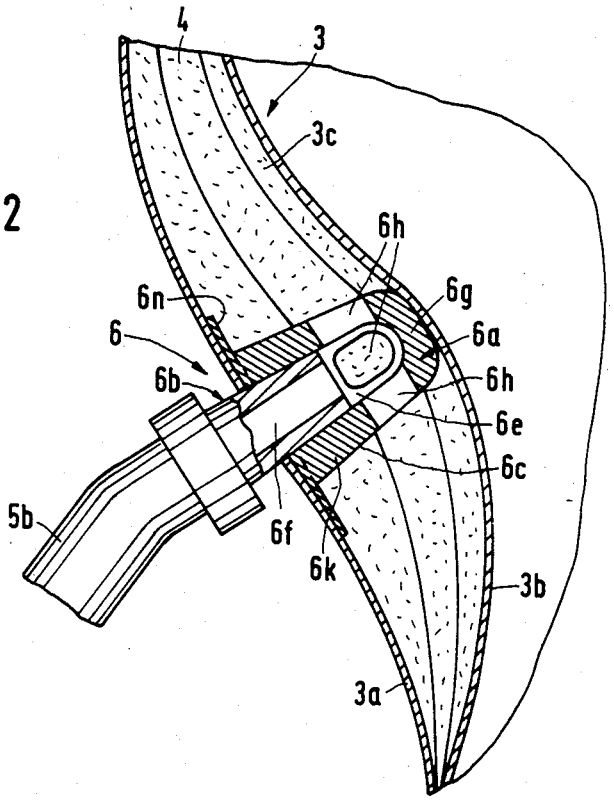
FIG. 2 is a section through an enlarged part of an almost empty packing to which a hose is connected via a coupling device according to the invention.
Figure 3:
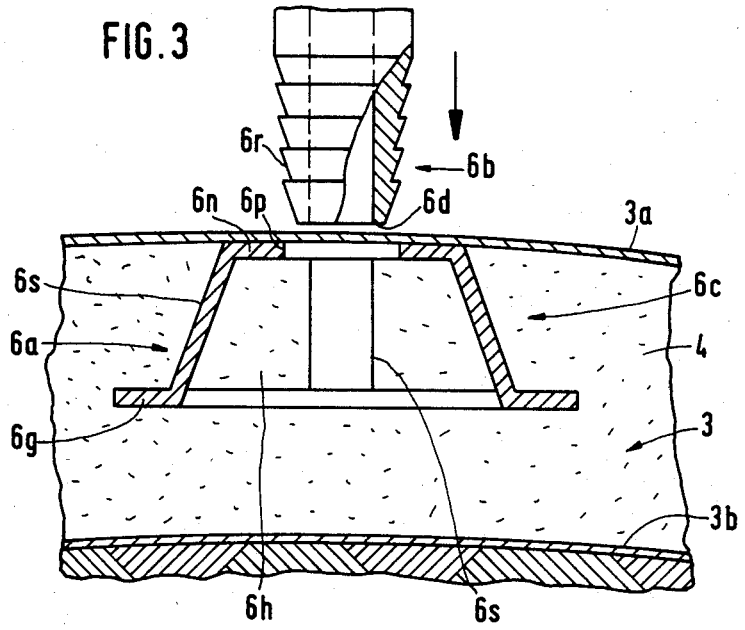
FIG. 3 is a section through a part of a filled packing before applying a hose via a coupling device according to the invention and FIG. 4 illustrates the part of the packing shown in FIG. 3 when connecting the hose via the coupling device according to FIG. 3.

The coupling means 6a may be designed in various ways. Thus, the coupling means 6a shown i FIGS. 1 and 2 has the shape of a sleeve while in FIGS. 3 and 4 the coupling means 6a comprises the ring 6n, legs 6s extending inwards therefrom and an inner ring 6g, which forms the support portion of the coupling means 6a facing the wall 3b. At this double-ring embodiment of the coupling means 6a, huge material inlets 6h are obtained, since these are formed between the three or four relatively thin legs 6s.

The embodiments described above and shown on the drawings may vary within the scope of the following claims regarding the design of details. It may be noted that the coupling means 6a of the packing 3 preferably is made of thermoplastic material such that it may be "welded" to the wall 3a of foil material. In order to provide an especially simple and durable arrangement, the wall 3a of foil material of the packing 3 may be made of a laminated polyester foil while the wall 3b is made of a polyamide foil. These foils 3a, 3b are "welded together" and together they form the suspension portion 3d of the packing 3. It may be finally noted that the packing may be of the single-use type or of another type, that the packing may be of another material than plastic foils, that the packing may be intended for other material than viscous masses and that the coupling means 6b may have another form than the form shown and described.

I claim:

1. A coupling device for connecting a material discharge to a pliable packing, comprising:

packing coupling means positioned entirely within opposing walls of the packing; and material discharge coupling means engagable with said packing coupling means when said packing is suspended;

wherein said packing coupling means includes a first ring of elastic material attached along an inner surface of a first opposing wall of the packing, said first ring provided with a gripping portion for retainable engagement of the material discharge coupling means, and a second ring spaced from the plane of the first ring and extending into the interior of the packing, said second ring connected to said first ring by means of a plurality of spaced legs;

wherein the legs extend obliquely from the first ring to the second ring, the packing coupling being thereby divergent from the first to the second ring;

wherein the first ring of elastic material is attached along an annular surface thereof to an unbroken portion of the first opposing wall;

wherein the second ring of the packing coupling has a planar surface facing the inner surface of the packing wall opposite the wall to which the first ring is attached;

wherein the first and second rings of the packing coupling are planar and extend parallel to each other;

wherein the material discharge coupling means includes a grip portion having peripheral teeth and a conically tapered shape for engagement with the gripping portion of the packing coupling means;

wherein engagement of the material discharge coupling means breaks the surface of the first opposing wall; and wherein the legs of the packing coupling are connected to the inner edge of the second ring, said second ring having a substantially larger outer diameter than the first ring.

* * * * *